US007419359B2

(12) United States Patent
Spaggiari

(10) Patent No.: US 7,419,359 B2
(45) Date of Patent: Sep. 2, 2008

(54) AXIAL IMPELLER WITH ENHANCE FLOW

(75) Inventor: Alessandro Spaggiari, Correggio (IT)

(73) Assignee: SPAL Automotive S.R.L, Correggio (IT)

( * ) Notice: Subject to any disclaimer, the term of this patent is extended or adjusted under 35 U.S.C. 154(b) by 388 days.

(21) Appl. No.: 10/574,501

(22) PCT Filed: Jul. 18, 2005

(86) PCT No.: PCT/IB2005/002168

§ 371 (c)(1),
(2), (4) Date: Apr. 3, 2006

(87) PCT Pub. No.: WO2006/011036

PCT Pub. Date: Feb. 2, 2006

(65) Prior Publication Data

US 2008/0044292 A1 Feb. 21, 2008

(30) Foreign Application Priority Data

Jul. 23, 2004 (IT) ..... BO2004A0468

(51) Int. Cl.
*F03B 3/12* (2006.01)
*F04D 29/38* (2006.01)

(52) U.S. Cl. ..... 416/183; 416/169 A; 416/234; 416/238

(58) Field of Classification Search ..... 416/183, 416/234, 235, 228, 243, 241, 238, 169 A, 416/244 R, DIG. 5, DIG. 2
See application file for complete search history.

(56) References Cited

U.S. PATENT DOCUMENTS

| | | | | |
|---|---|---|---|---|
| 3,127,093 | A | 3/1964 | Sudrow | |
| 3,334,807 | A * | 8/1967 | McMahan | 415/207 |
| 6,659,724 | B2 * | 12/2003 | Takeuchi et al. | 416/185 |

FOREIGN PATENT DOCUMENTS

| | | |
|---|---|---|
| EP | 0 557 239 A2 | 8/1993 |
| EP | 0 945 625 A1 | 9/1999 |
| EP | 1 016 788 A2 | 7/2000 |

* cited by examiner

*Primary Examiner*—Edward Look
*Assistant Examiner*—Dwayne J White
(74) *Attorney, Agent, or Firm*—Nath Law Group; Jerald L. Meyer; Derek Richmond

(57) ABSTRACT

An axial impeller (1), with enhanced flow, rotating in a plane (XY) about an axis (2) comprises a central hub (3), whose diameter is smaller than the diameter of the drive motor (3*a*), a plurality of blades (4) having a base (5) and a tip (6), the blades (4) being delimited by a convex leading edge (7) and by a convex trailing edge (8), whose projections onto the plane of rotation of the impeller are each defined by circular arc segments; the blades (4) are composed of sections having aerodynamic profiles (18) each having a decreasing length and an increasingly curved shape starting at the edge towards the hub; towards the hub each blade (4) has a box-shaped portion (20) that forms a wide scat (21) providing housing for an drive motor (3*a*) having a diameter that corresponds substantially to the seat (21).

21 Claims, 4 Drawing Sheets

AXIAL IMPELLER WITH ENHANCE FLOW

TECHNICAL FIELD

This invention concerns an axial impeller with enhanced flow equipped with blades that are inclined in the plane of rotation of the impeller and a hub having small dimensions.

BACKGROUND ART

The impeller according to the present invention may be used for various applications, for example, for moving air through a heat exchanger or radiator of an engine cooling system for a vehicle or similar apparatus; or for moving air through a heat exchanger for heating equipment and/or through air conditioning evaporators used in vehicle cabins.

Furthermore, the impeller according to the present invention may be used to move air in fixed air conditioning or heating equipment in homes.

Impellers of this type must meet various requirements, including: low noise, high efficiency, compact size, ability to achieve good head (or pressure) values and flow.

In order obtain a good flow of air by using impellers whose dimensions are small, it may be necessary to extend the blades towards the centre of the impeller itself, thereby increasing the flow in the central portion.

An impeller of this type is described in U.S. Pat. No. 6,126,395; its compact impeller features an extension of the blades towards the centre of the impeller, the blades are connected and overlap a hub.

The latter presents a curved area containing the stator of the actuator motor, while each blade contains a permanent magnet that works with the stator in order to create the torque necessary for rotation.

Due to the structure of the hub surrounding the stator it is difficult to change the type and size of the motor that rotationally drives the impeller.

Depending on the type of application and in order to obtain the best performance, it may be necessary to fit impellers of a certain size with electric motors of different sizes and power ratings.

In particular, to meet standardization requirements, it may be necessary to use motors with diameters that are relatively wide on impellers that are compact in size.

DISCLOSURE OF THE INVENTION

One aim of the present invention is to produce an impeller that features enhanced air flow, whose overall dimensions are generally small.

According to one aspect, the present invention provides an axial impeller as defined in claim 1.

The dependent claims refer to preferred, advantageous embodiments of the invention.

DESCRIPTION OF THE DRAWINGS

The accompanying drawings illustrate an embodiment of the present invention without limiting the scope of its application, in which.

DETAILED DESCRIPTION OF THE PREFERRED EMBODIMENTS OF THE INVENTION

Figure 1:
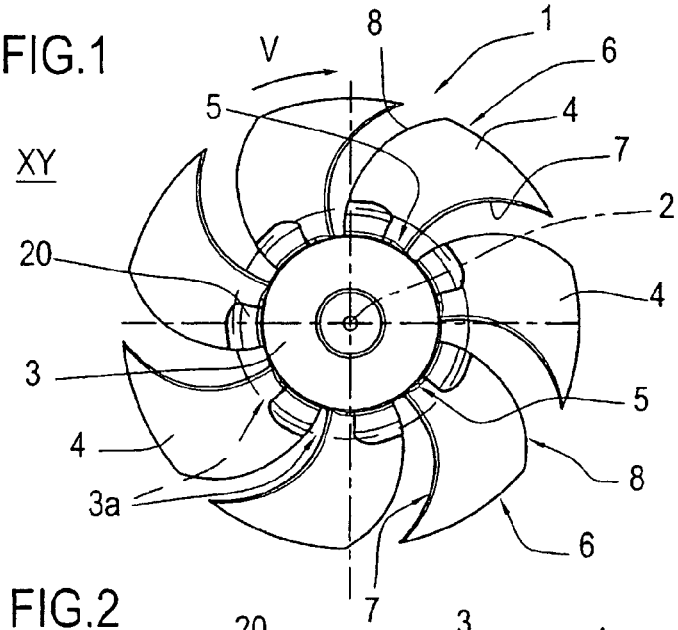
FIG. 1 shows a front view of the impeller according to the present invention.
Figure 2:
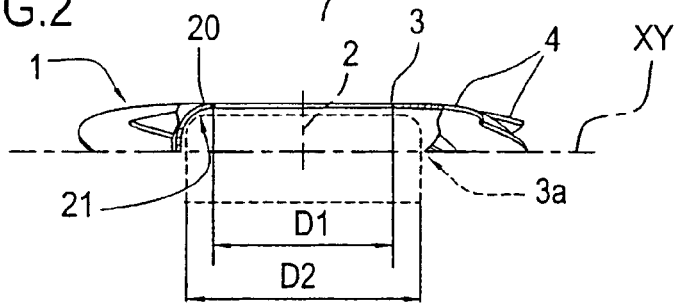
FIG. 2 shows a sectional view of the impeller of FIG. 1.

As shown in the accompanying drawings, the impeller 1 turns about an axis 2, in a plane XY, and comprises a central hub 3 with diameter D1 to which a plurality of blades 4 are attached, which are curved in the plane XY of rotation of the impeller 1.

The impeller 1 is driven by an electric motor 3*a*, having a diameter D2, which in general is different from the diameter D1 of the hub 3 and, more specifically, the motor 3*a* has a diameter D2 that is greater than the diameter D1 of the hub 3, as a result of which the blades 4 overlap the motor 3*a*.

The blades 4 have a base 5, a tip 6 and are delimited by a concave leading edge 7 and a convex trailing edge 8.

Figure 4:
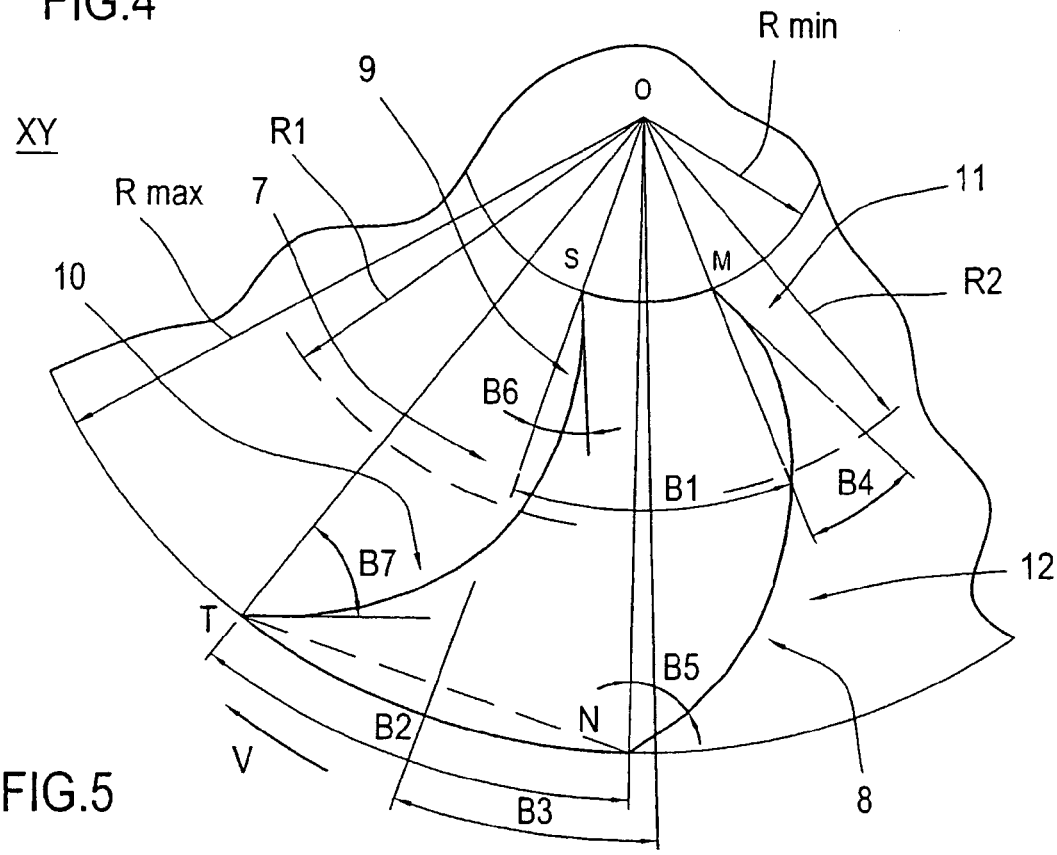
FIG. 4 shows a schematic front view of a blade of the impeller shown in the previous figures.

In order to achieve the best results in terms of efficiency, flow and air pressure, the invention specifies that the impeller 1 should rotate in accordance with direction of rotation V, shown in FIGS. 1 and 4, so that the tip 6 of each blade 4 meets the airflow prior to the base 5.

FIG. 4 shows an example of the geometric features of a blade 4: the leading and trailing edges 7, 8 are each delimited by two circular arc segments 9, 10 and 11, 12, respectively, having a radius R1 and R2, at which the one arc segment changes to the other arc segment having a different radius.

In the example of FIG. 4, the general dimensions of a blade 4 projected onto the plane XY are shown in table 1 below:

TABLE 1

| | Dimensions of a blade 4 | | |
|---|---|---|---|
| | Internal segment radius (mm) | Change radius (mm) | External segment radius (mm) |
| Leading edge (Ref. 7) | 50.5 (Ref. 9) | 61.6 (Ref. R1) | 45.3 (Ref. 10) |
| Trailing edge (Ref. 8) | 29.3 (Ref. 11) | 49.9 (Ref. R2) | 46.4 (Ref. 12) |

The general geometric features of the blade 4 are defined in relation to a theoretical hub of 55 mm in diameter, that is, the blade 4, has a minimum radius of Rmin=27.5 mm at base 5, and an external diameter of 190 mm, that is, it has a maximum radius of Rmax=95 mm at the tip 6, and as a result the blade 4 has a theoretical radial extension of 67.5 mm As will be seen below, the hub 3 may have a different size, that is, it may be larger, in which case the blade 4 will be truncated at the effective diameter of the hub 3.

Since the blade 4 has a minimum radius of Rmin=27, 5 mm and a maximum radius of Rmax=95 mm, then, for the leading edge 7, the radius R1 at which a change of circular arc occurs corresponds to approximately half (or 50%) of the radial extension of the leading edge 7, that is, 67.5 mm, as specified above.

The portion 9 of the leading edge 7, which is closer to the base 5, is defined by a circular arc with a radius equal to approximately 53% of the radius Rmax, and the portion 10 of the leading edge 7, closer to the tip 6, is defined by a circular arc segment with a radius equal to approximately 47% of the radius Rmax of the blade 4.

For the trailing edge 8, the radius R2 at which the change in the circular arc occurs is approximately one third (or 33%) of the radial extension of the leading edge, namely 67.5 mm The portion 11 of the trailing edge 8, closer to the base 5, is defined by an arc with a radius equal to approximately 30% of the radius Rmax of the blade 4; the portion 12 of the trailing edge 8, closer to the tip 6, is defined by an arc with a radius equal to approximately 49% of the radius Rmax of the blade 4.

The dimensions as percentages are shown in table 2 below:

TABLE 2

Dimensions of a blade 4 as percentages

| | Internal segment radius (% of Rmax) | Change radius (% of blade extension = Rmax-Rmin) | External segment radius (% of Rmax) |
|---|---|---|---|
| Leading edge (Ref. 7) | 53 (Ref. 9) | 50 (Ref. R1) | 47 (Ref. 10) |
| Trailing edge (Ref. 8) | 30 (Ref. 11) | 33 (Ref. R2) | 49 (Ref. 12) |

Satisfactory results were achieved in terms of flow, pressure and noise, even with values around these percentage dimensions. In particular, in accordance with the information set out above in percentage terms, it would be possible to achieve variations of plus or minus 10% of the dimensions indicated above.

The percentage ranges in relation to the dimensions are shown in table 3 below:

TABLE 3

Percentage ranges for the edges of a blade 4

| | Internal segment radius (% of Rmax) | Change radius (% of blade extension = % of Rmax-Rmin) | External segment radius (% of Rmax) |
|---|---|---|---|
| Leading edge (Ref. 7) | 47.7-58.3 (Ref. 9) | 45-55 (Ref. R1) | 42.3-51.7 (Ref. 10) |
| Trailing edge (Ref. 8) | 27-33 (Ref. 11) | 29.7-36.3 (Ref. R2) | 44.1-53.9 (Ref. 12) |

For the edges 7, 8 of the blade 4 in the area of the change in the circular arc, an appropriate connection may be provided so that the curve formed by the two edges 7, 8 is smooth and without cusps.

As regards the angular extension or width of the blades, again with reference to FIG. 4, the projection of the blade 4 onto the plane XY 5 makes, at the base 5, an angle B1 of approximately 41 degrees at the centre and, at the tip, an angle B2 of approximately 37 degrees at the centre.

In this case as well, satisfactory results were obtained in terms of flow, pressure and noise, with values for angles B1, B2 around these values. In particular, it would be possible to achieve variations of plus of minus 10% of these angles; thus, angle B1 may vary from 36.9 to 45.1 degrees while angle B2 may vary from 33.3 to 40.7 degrees.

In general, in view of the plastic material from which impellers are made, all of the dimensions and angles may vary by plus or minus 5% of the indicated values.

Considering the respective bisectors of angles B1, B2 and following the direction of rotation V of impeller 1, the tip 6 leads the base 5 by an angle B3 of approximately 21 degrees.

Other angles that are a feature of the blade 4 are angles B4, B5, B6, B7 (FIG. 4) formed by the respective tangents to the two edges 7, 8 and by the respective radii issuing from the centre of the impeller and passing through points S, T, N, M: the angles B4 and B5 are respectively 25 and 54 degrees and the angles B6, B7 are respectively 22 and 52 degrees.

There may be between four and nine blades 4 and, in accordance with the preferred embodiment, there are seven blades 4 arranged in accordance with differing angles.

The angles between one blade and the next—considering for example the corresponding leading edge 7 or trailing edge 8—are: 50.7; 106.0; 156.5; 205.2; 257;5; 312.9 (in degrees).

Using these angles provides an advantage with regard to noise, while the impeller 1 remains completely balanced both statically and dynamically.

Each blade 4 is made of a series of aerodynamic profiles that are connected progressively starting from the base 5 to the tip 6.

Figure 5:
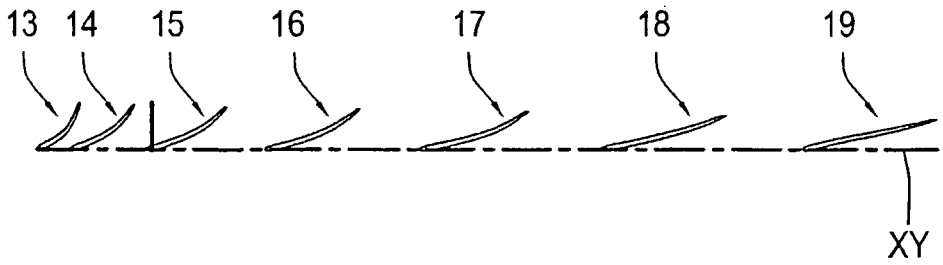
FIG. 5 shows a sectional view of some of the profiles taken at different widths of the impeller.

FIG. 5 shows seven profiles 13-19, that relate to respective sections taken at various intervals along the radial extension of a blade 4.

Figure 6:
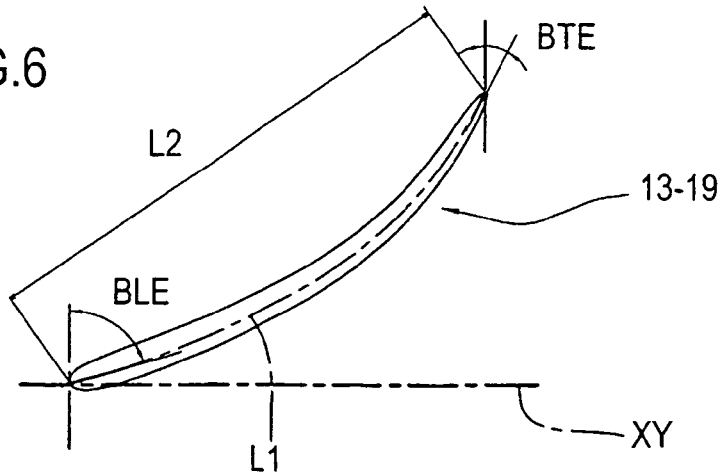
FIG. 6 shows a sectional view of a profile and its respective geometric features.
Figure 7:
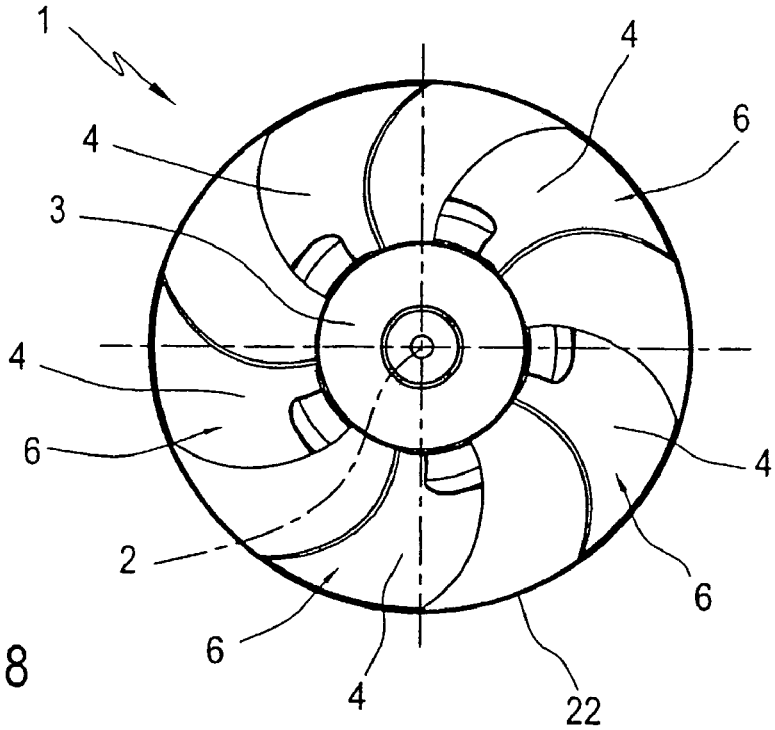
FIG. 7 shows a front view of a second embodiment of the impeller of FIG. 1.
Figure 8:
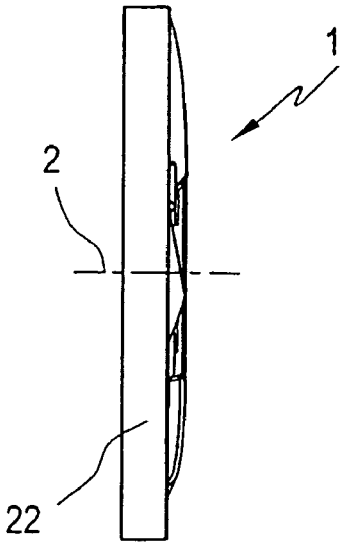
FIG. 8 shows a lateral view of the impeller of FIG. 7.
Figure 9:
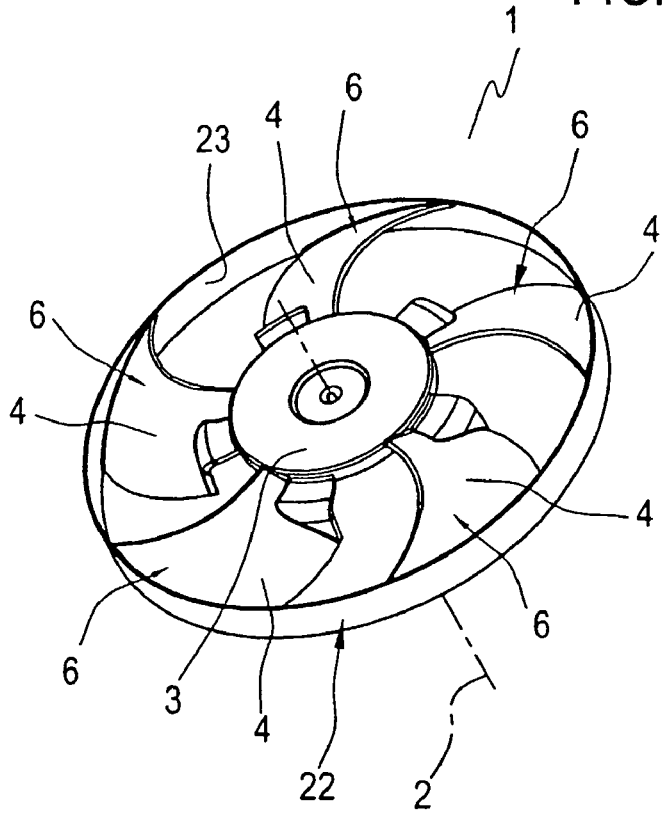
FIG. 9 shows a perspective view of the impeller of FIG. 7.

Profiles 13-19 are also defined by the geometric features exemplified in FIG. 6 for one of the profiles. As shown in FIG. 6, each profile 13-19 has a centre line L1 that forms a smooth curve, without flexes or cusps, and a chord L2.

Each profile 13-19 is furthermore characterized by two angles of incidence BLE, BTE at the leading edge and at the trailing edge, and these angles are formed by their respective tangents to the centre line L1 at the point of intersection with the leading edge and with the trailing edge and a respective straight line perpendicular to the plane XY through the corresponding intersection points.

Table 4 below shows, with reference to the seven profiles 13-19, the angles of leading edge BLE and of trailing edge BTE, the length of the centre line L1 and of the chord L2 of the profiles of a blade 4.

TABLE 4

Radial position, leading and trailing edge angles, centre line length and chord of blade 4 profiles

| Profile | Extension % | Radius (mm) | BLE (degrees) | BTE (degrees) | L1 (centre line mm) | L2 (chord mm) |
|---|---|---|---|---|---|---|
| 13 | 0 | 27.5 | 65 | 20 | 30.40 | 29.24 |
| 14 | 19.44 | 40.6 | 72 | 30 | 36.96 | 35.88 |
| 15 | 37.68 | 52.9 | 75 | 42 | 41.86 | 41.09 |

TABLE 4-continued

| Radial position, leading and trailing edge angles, centre line length and chord of blade 4 profiles | | | | | | |
|---|---|---|---|---|---|---|
| Profile | Extension % | Radius (mm) | BLE (degrees) | BTE (degrees) | L1 (centre line mm) | L2 (chord mm) |
| 16 | 55.89 | 65.2 | 77.5 | 50.5 | 47.04 | 46.43 |
| 17 | 72.59 | 76.5 | 80.58 | 56.27 | 53.50 | 52.88 |
| 18 | 88.35 | 87.1 | 79.34 | 62.02 | 59.30 | 59.13 |
| 19 | 1 | 95 | 73.73 | 72.55 | 62.51 | 62.5 |

It should be noted that the thickness of each profile 13-19, in accordance with the typical shape of wing profiles, initially increases, and reaches a maximum value of S-MAX at around 20% of the length of the centre line L1, and from there progressively decreases up to the trailing edge 8.

In percentage terms, the thickness S-MAX lies between 2.26% and 2.42% of the radius Rmax; the thickness of the profiles is distributed symmetrically about the centre line L1.

The positions of profiles 13-19 relative to the radial extension of a blade 4 and the respective values of the thickness in relation to their position with respect to the centre line L1 are shown in table 5 below.

As indicated previously, important features of the impeller 1 in accordance with this invention are provided by hub 3. The latter has a limited thickness and a diameter that is smaller than the diameter of motor 3*a*.

Between the hub 3 and each blade 4 there is also a box-shaped portion 20 which provides a connection, at least partially, between the hub 3 and each blade 4. For example, in the case illustrated in the drawings seven box-shaped portions 20 are shown, that is to say, the same number of portions as there are blades 4, which in turn are partially and directly attached to the hub 3 in the area near the leading edge 7.

TABLE 5

| Radial position and thickness values of blade 4 profiles | | | | | | | | | |
|---|---|---|---|---|---|---|---|---|---|
| | | | | Thickness | | | | | |
| | | | | dimensionless in relation to S-MAX | | | | | |
| Profile | Extension % | Radius (mm) | S-max (mm) | 0% L1 | 20% L1 | 40% L1 | 60% L1 | 80% L1 | 100% L1 |
| 13 | 0 | 27.5 | 2.18 | 0.569196 | 1 | 0.846665 | 0.719688 | 0.591336 | 0.109558 |
| 14 | 19.44 | 40.6 | 2.23 | 0.600601 | 1 | 0.89373 | 0.763659 | 0.623011 | 0.126933 |
| 15 | 37.68 | 52.9 | 2.23 | 0.69237 | 1 | 0.973294 | 0.816338 | 0.664273 | 0.172666 |
| 16 | 55.89 | 65.2 | 2.25 | 0.694791 | 1 | 0.934996 | 0.817809 | 0.667854 | 0.179252 |
| 17 | 72.59 | 76.5 | 2.26 | 0.697084 | 1 | 0.935484 | 0.819178 | 0.671675 | 0.185418 |
| 18 | 88.35 | 87.1 | 2.30 | 0.702375 | 1 | 0.936645 | 0.822311 | 0.673064 | 0.199574 |
| 19 | 1 | 95 | 2.15 | 0.731532 | 1 | 0.913833 | 0.777364 | 0.624127 | 0.168607 |

Table 6 below shows the actual thickness values in mm in relation to their position relative to the centre line L1 for each profile 13-19 referring to the embodiment illustrated in the drawings.

TABLE 6

| Thickness values in mm of Profiles 13-19 of a blade 4 | | | | | | |
|---|---|---|---|---|---|---|
| | Thickness (mm) | | | | | |
| Profile | 0% L1 | 20% L1 | 40% L1 | 60% L1 | 80% L1 | 100% L1 |
| 13 | 1.24 | 2.18 | 1.85 | 1.57 | 1.29 | 0.24 |
| 14 | 1.34 | 2.23 | 1.99 | 1.70 | 1.39 | 0.28 |
| 15 | 1.54 | 2.23 | 2.17 | 1.82 | 1.48 | 0.38 |
| 16 | 1.56 | 2.25 | 2.10 | 1.84 | 1.50 | 0.40 |
| 17 | 1.58 | 2.26 | 2.12 | 1.85 | 1.52 | 0.42 |
| 18 | 1.62 | 2.30 | 2.16 | 1.89 | 1.55 | 0.46 |
| 19 | 1.57 | 2.15 | 1.96 | 1.67 | 1.34 | 0.36 |

Preferably, profiles 13-19 are delimited by an elliptical connection, on the side of the leading edge 7, and by a truncation effected by a straight segment, on the side of the trailing edge 8.

The portions 20 match the external shape of the electric motor 3*a* and in general provide a seat 21 for the latter. The electric motor 3*a* is therefore partially contained within this seat 21 and accordingly it can be larger than-the hub 3.

The seat 21 has a diameter that is slightly greater than the diameter D2 of the motor 3*a* in order to allow the impeller 1 to rotate and also to accommodate motors whose diameters are slightly different.

It should be noted that, because the hub 3 is discoidal and the blades 4 have an angle of incidence at the base 5 that is relatively high, in the part near the trailing edge 8, the blades 4, cannot be attached directly to the hub 3.

In fact, the part near the trailing edge 8 is located in a position that is axially shifted with respect to the hub disk 3. The box-shaped portions 20 therefore enable a connection to be made between the hub 3 and the proximate part of the trailing edge 8 of the blades 4 and also to achieve a certain degree of stiffening of the blade 4 in the base 5.

Figure 3:
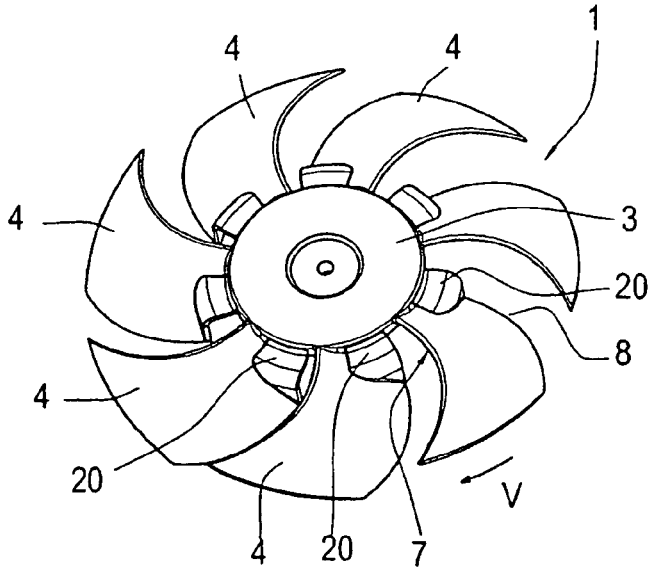
FIG. 3 shows a perspective view of the impeller shown in the previous figures.
Figure 3A:
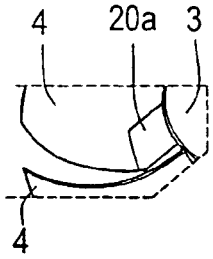
FIG. 3*a* shows a perspective view of a detail of a variation of the impeller according to the present invention.

In accordance with a variation of the invention shown in FIG. 3*a*, the impeller 1 has a discoidal hub 3 and a portion 20*a*, whose only function is to stiffen and connect the blade portions, proximate to the trailing edge 8, which is located in a position that is axially shifted with respect to the hub disk 3.

In this embodiment, the portion 20*a* does not specifically define a seat for the electric motor, which may have dimensions (in particular the diameter) that are comparable or smaller than those of the hub 3.

There is however, an increase in the airflow generated by the blades 4, because the discoidal shape of the hub 3 causes an increase in the section through which the airflow passes compared to a traditional solution in which the hub is equipped with a lateral skirt.

In the examples that are illustrated, the hub 3 has a diameter D1 of 75 mm, while the motor 3*a* has a diameter D2 of 100 mm The seat 21 has a diameter of approximately 105 mm in order to accommodate the motor 3*a*. Considering the data provided above, with regard to the blade 4, the latter is truncated at the base 5 to a diameter D1 of 75 mm, that is, to a radius of 37.5 mm, and, in the proximate part of the trailing edge 8, it is furthermore partially replaced by the portion 20.

Although the motor 3*a* overlaps the proximate part of the leading edge 7, it contributes to enhancing the airflow created by the impeller 1 and performance in general.

In the secondhand third embodiments, shown in FIGS. 7, 8, 9, 10, 11 and 12, the impeller 1 is also equipped with a ring 22 which is coaxial to the axis 2 of rotation and attached to the tip 6 of each blade 4. The ring 22 is defined by a cylindrical wall having a circular section, which is parallel to the axis 2 of rotation and has an internal area 23 that is integral with the tips 6 of the blades 4. The main function of the ring 22 is to stiffen-the blades 6, in order to limit their distortion caused by the centrifugal and aerodynamic forces. The ring 22 also makes it possible to guide the airflow through the disc defined by the blades 6 in a way that increases the efficiency of the impeller 1.

Figure 10:
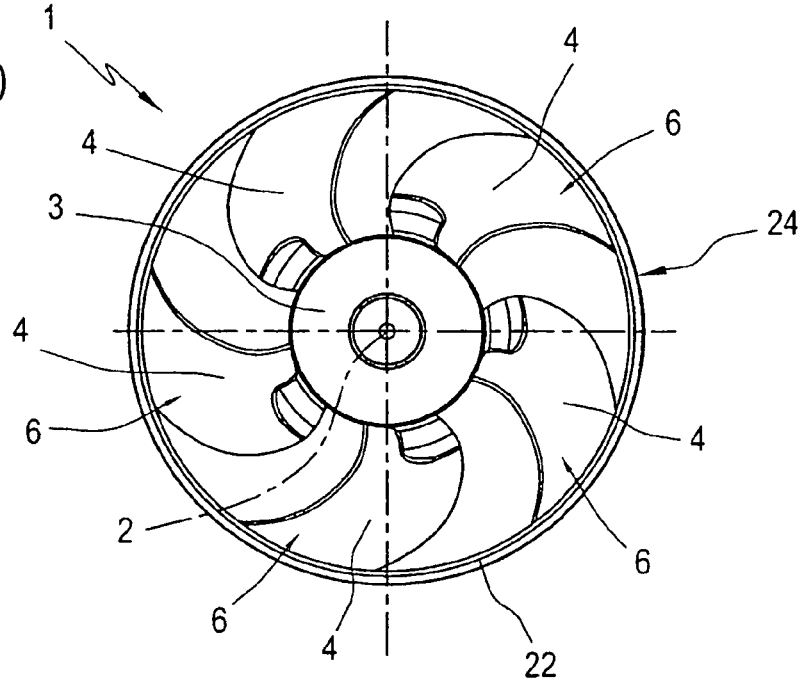
FIG. 10 shows a front view of a third embodiment of the impeller of FIG. 1.
Figure 11:
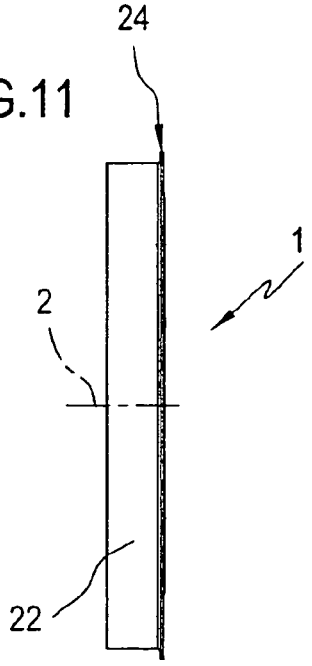
FIG. 11 shows a lateral view of the impeller of FIG. 10.
Figure 12:
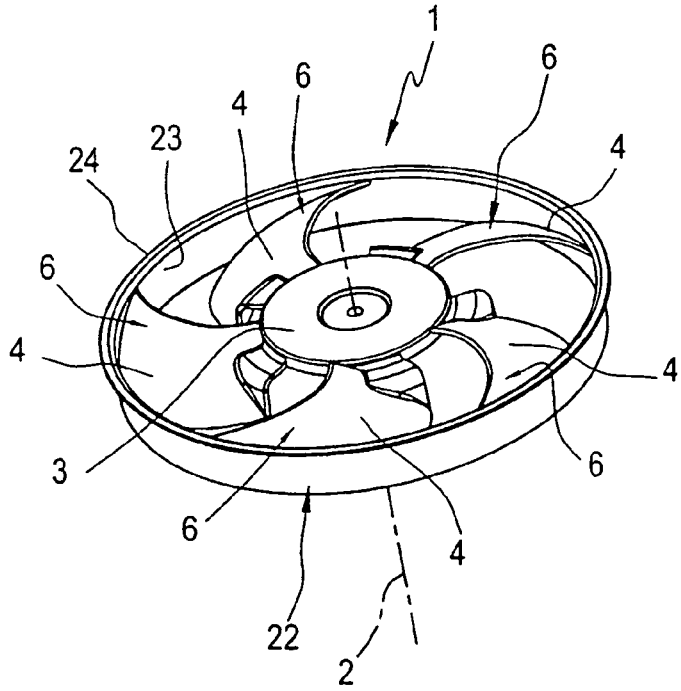
FIG. 12 shows a perspective view of the impeller of FIG. 10.

The third embodiment in FIGS. 10-12 is further equipped with a frame 24 attached to the edge of the ring 22 and extending radially away from the axis 2 of rotation. The frame has an outer portion which lies in a plane at right angles to the aforementioned axis 2 of rotation. Since the impeller 1 is usually mounted in an appropriate opening, located in a fixed support wall, the frame 24, which overlaps the wall, makes it possible to contain the airflow that passes outside the disk of the blades 6, between the blades 6 themselves and the internal edge of the aforementioned opening, in order to further improve the head values that can be achieved.

The impeller provided by this invention achieves numerous advantages.

As previously indicated, the discoidal shape without a lateral skirt of hub 3 causes an increase in the section through which the airflow passes and accordingly an increase in the flow itself.

Furthermore, even the blades that extend towards the centre of the impeller increase the airflow.

The seat created by the box-shaped portions 20 allows electric motors of a larger diameter to be fitted, and in particular it is possible to fit larger electric motors that provide a greater torque.

Accordingly it is possible to find the correct coupling between the impeller and electric motor, using an existing electric motor that generates the torque necessary for a certain type of impeller.

In this way it is possible to avoid the necessity of designing a new electric motor adapted in size to fit the impeller hub.

Furthermore, the lack of a lateral skirt in the hub and the extension of the blades towards the centre of the impeller, promotes the cooling of the electric motor.

The invention as described above may be modified and varied without departing from the scope of the inventive concept is defined in the claims.

LIST OF REFERENCE CHARACTERS

| Reference | Description |
|---|---|
| 1 | Axial impeller |
| 2 | Axis of rotation |
| 3 | Central hub |
| 3a | Electric motor |
| 4 | Impeller blade 1 |
| 5 | Base of blade 4 |
| 6 | Tip of blade 4 |
| 7 | Concave leading edge |
| 8 | Convex trailing edge |
| 9 | Internal arc segment of 7 |
| 10 | External arc segment of 7 |
| 11 | Internal arc segment of 8 |
| 12 | External arc segment of 8 |
| 13-19 | Aerodynamic profiles |
| 20 | Box-shaped portion |
| 20a | Stiffening portion |
| 21 | Seat for motor 3a |
| 22 | Ring |
| 23 | Internal surface of ring |
| 24 | Frame of ring |
| XY | Plane of rotation |
| V | Direction of rotation |
| R1 | Radius of change of segments 9 and 10 |
| R2 | Radius of change of segments 11 and 12 |
| XY | Projection in plane |
| B1-B7 | Characteristic angles of blade 4 |
| M, N, S, T | Characteristic points of blade 4 |
| L1 | Centre line |
| L2 | Chord |
| BLE | Angles of incidence at leading edge |
| BTE | Angles of incidence at trailing edge |
| D1 | Diameter of hub 3 |
| D2 | Diameter of motor 3 |
| Rmin | Theoretical hub radius |
| Rmax | External impeller radius |

The invention claimed is:

1. An axial flow impeller (1), rotationally driven by a motor (3*a*) about an axis (2) in a direction (V) in a plane (XY), comprising a central hub (3) of diameter (D1), a plurality of blades (4), each blade having a base (5) with a theoretical starting radius (Rmin), and a tip (6) that extends to an end radius (Rmax), the blades (4) being delimited by a concave leading edge (7) and a convex trailing edge (8), characterised in that the blades (4) include box-shaped portions (20) that define a seat (21) with a diameter (D2) greater than the diameter (D1) of the housing of the electric motor (3*a*).

2. The axial flow impeller (1) in accordance with claim 1, characterized in that it comprises a discoidal central hub (3), a plurality of blades (4); each blade having a base (5) with a theoretical starting radius (Rmin), and a tip (6) that extends to an end radius (Rmax), the blades (4) being delimited by a concave leading edge (7) and a convex trailing edge (8) and characterised in that the blades (4) include connecting and stiffening portions (20, 20*a*) between the hub (3) and the blades (4) themselves.

3. The axial flow impeller (1) in accordance with claim 1, characterised in that the leading edge (7) comprises a first circular arc segment (9) near the base (5) with a radius falling between 47.7% and 58.3% of the tip end radius (Rmax) and a second circular arc segment (10) near the tip (6) with a radius falling between 42.3% and 51.7% of the tip end radius (Rmax), and a radius of change between the two circular arc segments (9, 10) falling between 45% and 55% of the extension (Rmax-Rmin) of the blade (4).

4. The axial flow impeller (1) in accordance with claim 1, characterised in that the trailing edge (8) comprises a first circular arc segment (11) near the base (5) with a radius falling between 27% and 33% of the tip end radius (Rmax) and a second circular arc segment (12) near the tip (6) with a radius falling between 44.1% and 53.9% of the tip end radius (Rmax), and a radius of change between the two circular arc segments (11, 12) falling between 29.7% and 36.3% of the extension (Rmax-Rmin) of the blade (4).

5. The axial flow impeller (1) in accordance with claim 1, characterised in that the leading edge (7) comprises a first circular arc segment (9) near the base (5) with a radius equal to 53% of the tip end radius (Rmax) and a second circular arc segment (10) near the tip (6) with a radius equal to 47% of the tip end radius (Rmax), and a radius of change between the two circular arc segments (9, 10) that corresponds to 50% of the extension (Rmax-Rmin) of the blade (4).

6. The axial flow impeller (1) in accordance with claim 1, characterised in that the trailing edge (8) comprises a first circular arc segment (11) near the base (5) with a radius equal to 30% of the tip end radius (Rmax) and a second circular arc segment (12) near the tip (6) with a radius equal to 49% of the tip end radius (Rmax), and a radius of change between the two circular arc segments (11, 12) that corresponds to 33% of the extension (Rmax-Rmin) of the blade (4).

7. The axial flow impeller (1) in accordance with claim 1, characterised in that the width of the blade (4) at the base (5) projected onto the plane (XY) is such as to make at the centre of the impeller an angle (131) that falls between 36.9 and 45.1 degrees.

8. The axial flow impeller (1) in accordance with claim 1, characterised in that the width of the blade (4) at the tip (6) projected onto the plane (XY) is such as to make at the centre of the impeller an angle (32) that falls between 33.3 and 40.7 degrees.

9. The axial flow impeller (1) in accordance with claim 1, characterised in that the width of the blade (4) at the base (5) projected onto the plane (XY) is such as to make at the centre of the impeller an angle (B1) that is approximately equal to 41 degrees.

10. The axial flow impeller (1) in accordance with claim 1, characterised in that the width of the blade (4) at the tip (6) projected onto the plane (XY) is such as to make at the centre of the impeller an angle (B2) that is approximately equal to 37 degrees.

11. The axial flow impeller (1) in accordance with claim 1 characterised in that, considering the projection of the blade (4) onto the plane (XY) and the direction (V) of rotation of the impeller (1), the tip (6) leads the base (5) by an angle (B3) of approximately 21 degrees at the centre of the impeller.

12. The axial flow impeller (1) in accordance with claim 1, characterised in that the projection of the blade (4) onto the plane (XY) defines an intersection point (M) of the trailing edge (8) with the hub (3) and makes an angle (B4) equal to 25 degrees, the angle (B4) being formed by the respective tangent to the trailing edge (8) at point (M) and by a respective radius issuing from the axis (2) of the impeller (1) and passing through point (M).

13. The axial flow impeller (1) in accordance with claim 1, characterised in that the projection of the blade (4) onto the plane (XY) defines an intersection point (N) of the trailing edge (8) with the tip (6) and makes an angle (B5) equal to 54 degrees, the angle (B5) being formed by the respective tangent to the trailing edge (8) at point (N) and by a respective radius issuing from the axis (2) of the impeller (1) and passing through point (N).

14. The axial flow impeller (1) in accordance with claim 1, characterised in that the projection of the blade (4) onto the plane (XY) defines an intersection point (8) of the leading edge (7) with the hub (3) and makes an angle (B6) equal to 22 degrees, the angle (B6) being formed by the respective tangent to the leading edge (7) at point (S) and by a respective radius issuing from the axis (2) of the impeller (1) and passing through point (S).

15. The axial flow impeller (1) in accordance with claim 1, characterised in that the projection of the blade (4) onto the plane (XY) defines an intersection point (T) of the leading edge (7) with the tip (6) and makes an angle (B7) equal to 52 degrees, the angle (B5) being formed by the respective tangent to the leading edge (7) at point (T) and by a respective radius issuing from the axis (2) of the impeller (1) and passing through point (T).

16. The axial flow impeller (1) in accordance with claim 1, characterised in that the blade (4) is defined by at least some of the aerodynamic profiles (13-19) of respective sections taken at various intervals of the radial extension of a blade (4), each profile (13-19) being defined by a centre line (L1) forming a smooth curve, without flexes or cusps, and by two angles of incidence (BLE, BIT) at the leading edge and at the trailing edge, said angles being defined by the respective tangents to the centre line (L1) at the point of intersection with the leading edge and with the trailing edge and a respective line perpendicular to the plane (XY) passing through the corresponding intersection points and also characterised in that the angles (BLE, BTE) of the profiles (13-19) have the values shown in the table below:

| Profile | Radial extension (%) | Radius (mm) | BLE (degrees) | BTE (degrees) |
|---|---|---|---|---|
| 13 | 0 | 27.5 | 65 | 20 |
| 14 | 19.44 | 40.6 | 72 | 30 |
| 15 | 37.68 | 52.9 | 75 | 42 |
| 16 | 55.89 | 65.2 | 77.5 | 50.5 |
| 17 | 72.59 | 76.5 | 80.58 | 56.27 |
| 18 | 88.35 | 87.1 | 79.34 | 62.02 |
| 19 | 1 | 95 | 73.73 | 72.55. |

17. The axial flow impeller (1) in accordance with claim 1, characterised in that the blade (4) is defined by at least some of the aerodynamic profiles (13-19) of respective sections taken at various intervals of the radial extension of a blade (4), each profile (13-19) being defined by a centre line (L1) forming a smooth curve, without flexes or cusps, and also characterised in that the profiles (13-19) have a thickness S-MAX that falls between 2.26% and 2.42% of the tip end radius Rmax.

18. The axial flow impeller (1) in accordance with claim 15, characterised in that the profiles (13-19) have a thickness that is symmetrically arranged about the centre line (1,1) and a thickness that initially increases, a maximum value S-MAX of approximately 20% of the length of the centre line (L1), and then progressively decreases up to the trailing edge 8 and in that the thickness are those shown in the following table:

| | | | dimensionless thickness in relation to S-MAX | | | | | |
|---|---|---|---|---|---|---|---|---|
| Profile | Extension (%) | Radius (mm) | 0% L1 | 20% L1 | 40% L1 | 60% L1 | 80% L1 | 100% L1 |
| 13 | 0 | 27.5 | 0.569196 | 1 | 0.846665 | 0.719688 | 0.591336 | 0.109558 |
| 14 | 19.44 | 40.6 | 0.600601 | 1 | 0.89373 | 0.763659 | 0.623011 | 0.126933 |
| 15 | 37.68 | 52.9 | 0.69237 | 1 | 0.973294 | 0.816338 | 0.664273 | 0.172666 |
| 16 | 55.89 | 65.2 | 0.694791 | 1 | 0.934996 | 0.817809 | 0.667854 | 0.179252 |
| 17 | 72.59 | 76.5 | 0.697084 | 1 | 0.935484 | 0.819178 | 0.671675 | 0.185418 |
| 18 | 88.35 | 87.1 | 0.702375 | 1 | 0.936645 | 0.822311 | 0.673064 | 0.199574 |
| 19 | 1 | 95 | 0.731532 | 1 | 0.913833 | 0.777364 | 0.624127 | 0.168607. |

19. The axial flow impeller (1) in accordance with claim 1, characterised in that it comprises seven blades (4) arranged at unequal angular intervals; the angular intervals, expressed in degrees, between one blade (4) and the next—taking for example the corresponding leading edge (7) or trailing edge (8)—being the following: 50.7; 106.0; 156.5; 205.2; 257;5; 312.9.

20. The axial flow impeller (1) in accordance with claim 1, characterised in that it also comprises a ring (22) that is coaxial to the axis (2) of rotation and connected to the tip (6) of each blade (4).

21. The axial flow impeller (1) in accordance with claim 20, characterised in that it also comprises a frame (24) attached to the edge of the ring 22 and extending radially away from the axis 2 of rotation.

* * * * *

UNITED STATES PATENT AND TRADEMARK OFFICE

CERTIFICATE OF CORRECTION

PATENT NO. : 7,419,359 B2
APPLICATION NO. : 10/574501
DATED : September 2, 2008
INVENTOR(S) : Spaggiari It is certified that error appears in the above-identified patent and that said Letters Patent is hereby corrected as shown below:

On the face of patent,

Item 54, Column 1, Line 1, the word “Enhance” should read as -- Enhanced --.

Signed and Sealed this

Fourth Day of November, 2008

JON W. DUDAS
*Director of the United States Patent and Trademark Office*